US005893415A

United States Patent [19]

Ricks

[11] Patent Number: 5,893,415

[45] Date of Patent: Apr. 13, 1999

[54] GAS DIVERSION TOOL

[75] Inventor: Thomas E. Ricks, Odessa, Tex.

[73] Assignee: T-Rex Technology, Inc., Odessa, Tex.

[21] Appl. No.: 08/803,512

[22] Filed: Feb. 20, 1997

[51] Int. Cl.[6] ..... E21B 43/00

[52] U.S. Cl. ..... 166/277; 166/313; 166/372; 166/242.3; 166/151

[58] Field of Search ..... 166/277, 313, 166/386, 129, 145, 148, 151, 183, 185, 186, 372, 242.5, 242.3

[56] References Cited

U.S. PATENT DOCUMENTS

| | | | |
|---|---|---|---|
| 1,139,745 | 5/1915 | Ames . | |
| 1,238,165 | 8/1917 | Lynn . | |
| 1,536,348 | 5/1925 | Mack . | |
| 2,804,147 | 8/1957 | Pistole et al. | 166/14 |
| 2,913,054 | 11/1959 | Falk | 166/224 |
| 3,215,087 | 11/1965 | McLeod, Jr. | 166/372 |
| 3,625,288 | 12/1971 | Roeder | 166/314 |
| 4,335,786 | 6/1982 | Smith | 166/372 |
| 4,700,783 | 10/1987 | Baron | 166/372 |
| 4,834,176 | 5/1989 | Renfroe, Jr. | 166/142 |
| 4,844,156 | 7/1989 | Hesh | 166/263 |
| 4,844,166 | 7/1989 | Going, III et al. | 166/372 |
| 5,046,558 | 9/1991 | Koster | 166/243 |
| 5,390,737 | 2/1995 | Jacobi et al. | 166/184 |
| 5,404,945 | 4/1995 | Head et al. | 166/242.3 |
| 5,507,343 | 4/1996 | Carlton et al. | 166/277 |
| 5,562,161 | 10/1996 | Hisaw et al. | 166/372 |

*Primary Examiner*—William Neuder
*Attorney, Agent, or Firm*—Jacobson, Price, Holman & Stern, PLLC

[57] ABSTRACT

A gas diverter tool is disclosed for use in improving the operation of an oil and gas well that has cracks, holes or leaks in the casing. The tool includes a thick walled tubular body for in-line threaded connection within a tubing string below a packer carried by the tubing string. The thick wall of the tubular body includes four circumferentially spaced passageways extending longitudinally therethrough to provide gas inlet openings. The upper ends of the passageways are removably closed, and the lower ends are diametrically reduced to provide valve seats. Spherical check valves are loosely received within the passageways above to seat downwardly against the valve seats. Elongated wiper rods are loosely slidable in the passageways and downwardly abut against the ball valves to hold the check valves closes. Intermediate the length of the interior of the body, an undercut portion is provided which opens into the adjacent sides of the passageways to provide a passageway for gas from the exterior of the tool to the interior of the tool and thence to the interior of the tubing.

28 Claims, 3 Drawing Sheets

GAS DIVERSION TOOL

CROSS REFERENCE TO RELATED APPLICATIONS

Not applicable

STATEMENT REGARDING FEDERAL SPONSORED RESEARCH FOR DEVELOPMENT

Not applicable

BACKGROUND OF THE INVENTION

1. Field of the Invention

This invention relates to an oil field tool for use in an oil and gas well where the casing is cracked or otherwise leaking to seal off the well below the crack or leak and divert the gas to the inside of the tubing for travel to the surface. More specifically, the present invention relates to a tubular body serially connected in a well tubing string below a packer and includes valved passageways for the passage of the well gas from the exterior of the tubing string to the interior of the body for carrying the gas up the tubing string to the surface.

2. Description of Related Art

Oil and gas wells with cracked casings present problems to economical removal of the oil and gas. Typically, the crack or hole in the casing permits contaminating materials, such as water and mud, to enter the well and flood out the productive oil and gas zone, thereby rendering a marginal well uneconomical to pump the oil to the surface. The conventional solution is to repair the casing at the crack or hole by the "cement squeeze" process; however this is very costly and is not economically feasible in marginal wells. Further, there is no assurance a "cement squeeze" repair will hold. Thus, there is a great demand for a simple and inexpensive tool which can be utilized in wells having a cracked or leaking casing, especially marginal wells, to make the wells productive. The U.S. patent art includes various prior patents which disclose excess gas pressure diversion and venting structures as well as sealing and fluid bypass structures that pertain to improvements in well production. For example, Mack U.S. Pat. No. 1,536,348 discloses a gas venting tool disposed in a tubing string below a packer and capable of enabling the flow of gas from the exterior of the tubing string into the interior of the latter. However, the Mack gas venting tool is made as part of the packer and is designed to be used in conjunction with and sealed relative to the upper end of a "bottom casing".

Lynn U.S. Pat. No. 1,238,165 also discloses a gas venting tool, but the Lynn tool is interposed between two laterally offset tubing sections and therefore prevents the passage of various repair and/or service tools downwardly through the tubing string past the venting tool. Also, it would appear that the Lynn tool would not provide sufficient clearance for a pump rod. Carlton et al. U.S. Pat. No. 5,507,343 discloses an apparatus for repairing a damaged well casing and employs two packers with gas vents.

Ames U.S. Pat. No. 1,139,745 is directed toward an apparatus for evacuating gas from a closed well to permit the continuing flow of oil into the well casing. Roeder U.S. Pat. No. 3,625,288 discloses a pump assembly providing a plurality of passageways to accommodate oil, gas and power fluid flow as well a structure for alternately using the various passageways. Jacobi U.S. Pat. No. 5,390,737 discloses a packer assembly with a sliding valve to be opened or closed manually, and Renfroe U.S. Pat. No. 4,834,176 discloses a device for opening a valve to communicate the exterior and interior of the tool. The patents to Pistole et al., U.S. Pat. No. 2,804,147 and to Koster, U.S. Pat. No. 5,046,558 disclose structures for sealing leaks in casings. Finally, Falk U.S. Pat. No. 2,913,054 discloses a device for closing a connection in the tubing string between different zones separated by a packer, and Hesh U.S. Pat. No. 4,844,156 discloses a method for promoting increased formation flow.

However, the prior art does not disclose a simple and inexpensive tool that can be readily inserted into a tubing string below a casing sealing (tension) packer and that will divert gas buildup outside of the tubing below the packer and allow the gas to flow to the surface along with the oil being pumped up the tubing.

SUMMARY OF THE INVENTION

To overcome the deficiencies of the prior art, the present invention comprises a gas diversion tool which can be readily installed in an existing tubing string, and a conventional tension packer is attached above the tool. The point of attachment is at a location that places the packer and tool below the crack or hole in the casing when the system is completely installed. Once the tool and packer are in place, the packer is activated to seal off the casing below the crack and thereby prevent migration of the contaminating materials from the crack to the bottom of the well. The sealing of the casing also prohibits the upward flow of gases from below the packer and outside the tubing to the surface. As the oil and gas enter the well, the oil falls to the bottom, where it can be pumped to the surface, and the gas flows upward. When there is a gas pressure buildup inside the casing, the tool automatically diverts this gas into the tubing, where it can then flow to the surface.

The gas diversion tool in accordance with the present invention incorporates a simple thick walled cylindrical body with appropriate threads, top and bottom, for serial connection within a tubing string and preferably includes several vertical gas inlets peripherally around the tool body. These inlets each lead to a check valve which permits the gas to enter the interior of the tool responsive to a specific differential in the pressure of the gas in the space between the outside of the tubing and the inside of the casing above the pressure of fluid within the tubing string. The interior of the tool is generally in line with the interior of the tubing so that the gas entering the interior of the tool can then pass up the tubing with the oil that is being pumped up the tubing to the surface. Further, this in line alignment of the interior of the tool with the interior of the tubing introduces no obstruction to the passage of various tools therethrough for performing repair or maintenance functions within an associated well below the gas diversion tool.

In a preferred embodiment, the gas inlets and check valve assemblies consist of a plurality of circumferentially spaced straight longitudinal through bores in the thick wall of the cylindrical body with the upper ends of the through bores being provided with diametrically enlarged counterbores whose lower ends define upwardly opening valve seats. A ball check valve and cylindrical hold down and wiper rod are received in each counterbore and the upper end of each counterbore is removably closed. The interior of the thick walled tubular body includes a circumferentially extending undercut portion opening slightly into the adjacent sides of the counterbores appreciably above the lower ends thereof. Hence, when the gas pressure outside the tool and inside the sealed casing exceeds the fluid pressure within the tubing string by a predetermined amount, the gas pressure causes the ball check valve and cylindrical hold down and wiper rod to move upwardly to a point which permits the higher pressure gas to enter into the interior of the tool through openings in the sides of the counterbores. The gas then passes into the interior of the tool, whereby the higher pressure gas vents upwardly through the interior of the tubing. The combined weight of the ball check valve and wiper rod counters the pressure of the inlet gas until it reaches the design opening minimum pressure differential. In accordance with the present invention, it has been found that the design minimum pressure differential for initial opening the check valves in accordance with the tool of the present invention should be about 2 psi and that full opening of the check valves should be at about 7 psi.

In accordance with the foregoing, an object of this invention is to provide a well gas diversion tool which may be conventionally serially connected within a tubing string through the use of threaded connections with the tubing string and which will be capable of diverting gas pressure from the exterior of the tubing string to the interior thereof responsive to a predetermined differential in fluid pressure exteriorly of the tubing string over the fluid pressure within the tubing string.

Another object of this invention is to provide a gas diversion tool which may be serially connected within a tubing string in a manner to enable all repair and maintenance tools moving downwardly through the tubing string to also pass easily through the tool.

A further object of this invention is to provide a gas pressure diversion tool of simple construction, which includes inexpensive components and which may be manufactured by inexpensive manufacturing procedures.

Yet another object of this invention is to provide a gas diversion tool including check valve assemblies which are highly dependable in operation and offer a long life expectancy of operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
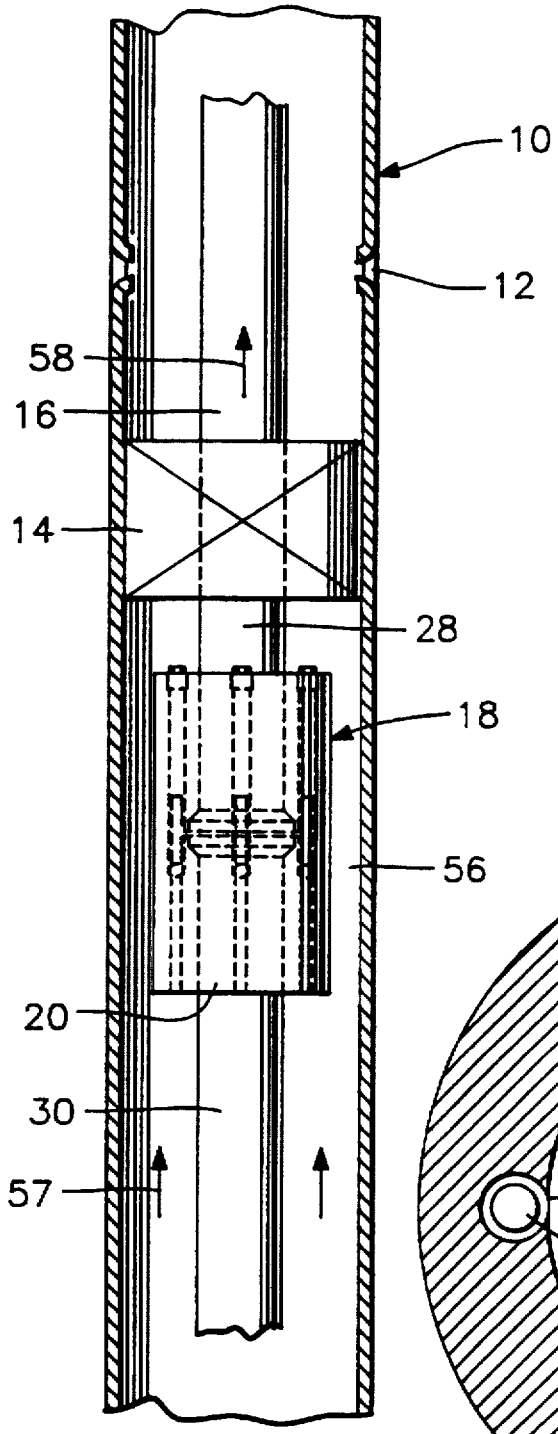
FIG. 1 is a fragmentary vertical sectional view of a well casing including a perforated upper portion below which a tubing string supported packer has been installed and with a preferred embodiment of the gas diversion tool of the instant invention serially connected in the tubing string below the packer.
Figure 5:
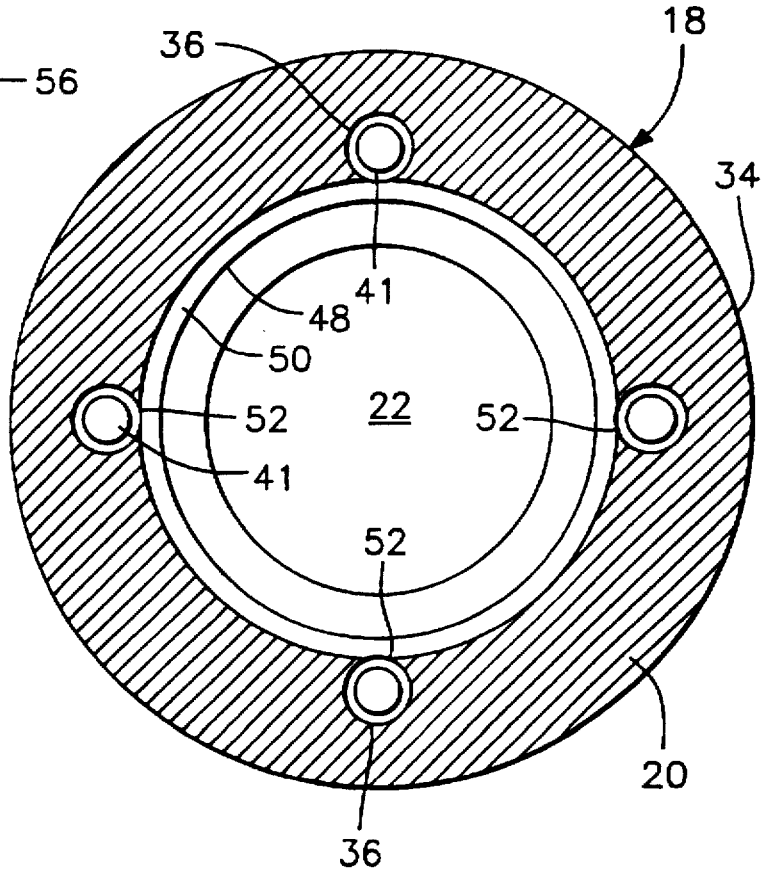
FIG. 5 is a cross-sectional view taken along line 5—5 of FIG. 2.

In describing the preferred embodiment of the present invention as illustrated in the drawings, specific terminology will be resorted to for the sake of clarity. However, the invention is not intended to be limited to the specific embodiment illustrated and terms so selected; it being understood that each specific term includes all technical equivalents which operate in a similar manner to accomplish a similar purpose.

Referring now more specifically to the drawings, numeral 10 generally designates an in ground well casing including a perforated or leaking area 12, such as caused by corrosive water or the like. The perforated area 12 allows water and mud to enter the casing and to fall downwardly to the bottom of the well contaminating the oil and gas entering the casing through the production zone or zones (not shown). The water and mud interfere with pumping the oil and gas to the surface and the static pressure of such water and mud at the production zone can actually completely stop oil flow from the production zone into the well casing.

When such a condition exists in a "marginal well", the well becomes unprofitable to pump and in many cases the well is so "marginal" that expensive repair of the perforated area 12 is not carried out and the well is shut down. Although it is possible to prevent the downward flow of the water and mud from the perforated area 12 to the bottom of the casing 10 through the utilization of a packer 14 connected in a tubing string 16 extending downwardly through the casing 10, see FIG. 1, in almost all cases the utilization of packer 14 within the casing 10 results in gas pressure within the casing 12 below the packer 14 being elevated to an extent that oil production into the lower end of the casing is either terminated or severely retarded, thereby also rendering oil production from the well uneconomical.

In order to restore or bring back such marginal wells into production, a gas diversion tool referred to generally by the reference numeral 18 and constructed in accordance with the present invention is serially connected within the tubing string 16 below the packer 14. The gas diversion tool 18 includes a thick walled cylindrical body 20, see FIG. 2, having a central longitudinal opening or passageway 22 defined therethrough. The opening 22 includes threaded upper and lower ends 24 and 26 at the top and bottom, respectively, thereof. In this manner, the tubing section 28 above the gas diversion valve 18 may be threaded downwardly into the threaded upper end 24 of the central longitudinal opening 22, and the tubing section 30 disposed immediately below the gas diversion tool 18 may have its upper end threaded into the threaded lower end 26 of the opening 22.

In addition to the central longitudinal opening or passageway 22, a series of preferably four longitudinal through bores 32 are formed through the body 20 at points spaced circumferentially thereabout generally intermediate the outer surface 34 of the body 20 and the inner surface 35 of the central longitudinal opening 22. The bores 32 include upper and diametrically enlarged counterbores 36 extending downwardly through generally two thirds the length of the body 20 and defining upwardly facing annular seats 38 at their lower ends.

A ball check valve 40 is downwardly received in each counterbore 36 and loosely seated against the corresponding seat 38. In addition, a cylindrical rod 41 which acts as a valve hold down and wiper is also positioned in each counterbore 36 and loosely seats downwardly upon the top of the corresponding ball check valve 40. Typically, the central longitudinal opening or passageway 22 may be about 2 ⅞ inches in diameter, the counterbores 36 about 7/16 inch in diameter, the rods 41 about 5/16 inch in diameter and the ball check valves 40 about ⅞ inch in diameter.

The upper ends of the counterbores 36 include threaded second counterbores 42 in which threaded plugs 44 are removably threaded to sealingly close the upper ends of the bores 32. Meanwhile, the lower ends of the bores 32 open downwardly through the lower axial end face 46 of the body 12 to provide inlets 47 for the gas into bores 32.

The approximate longitudinal mid-point of the rods 41 are aligned with the longitudinal midpoint of the body 20 and the longitudinal midpoint of the body 20 includes a first undercut zone 48 of appreciable axial extent and a second undercut zone 50 of much shorter axial extent which opens into the adjacent sides of the counterbores 36 to define a circumferentially spaced slot 52 for each counterbore 36. Thus, when the tool includes four bores 32 and counterbores 36, there will be four slots 52. The slots 52 thus communicate the undercut zone 50 with the counterbores 36 in which the ball check valve 40 and cylindrical wipers 41 are loosely received.

Figure 2:
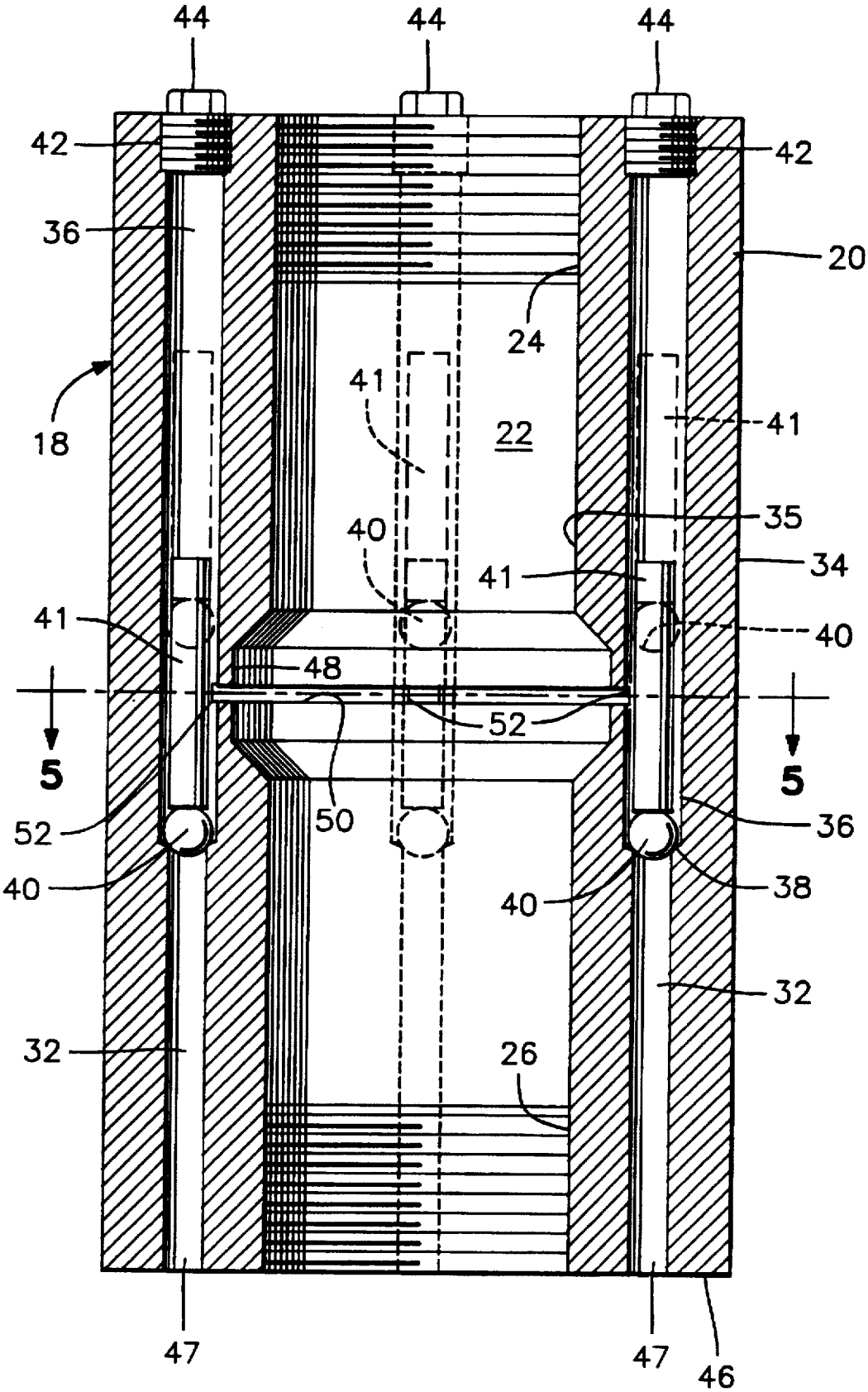
FIG. 2 is an enlarged vertical sectional view of the preferred embodiment of the gas diversion tool of the present invention.
Figure 3:
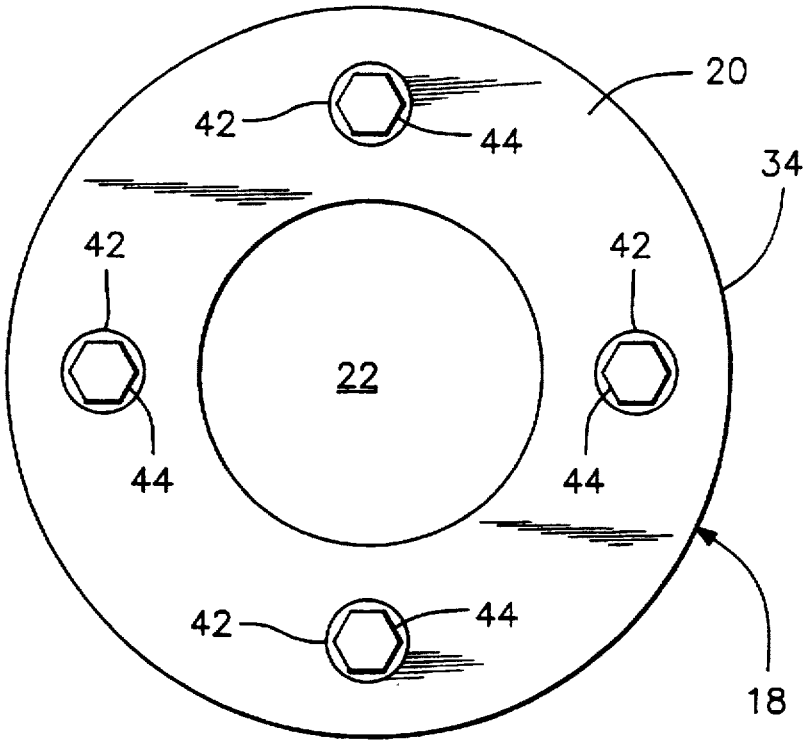
FIG. 3 is a top plan view of the tool illustrated in FIG. 2.
Figure 4:
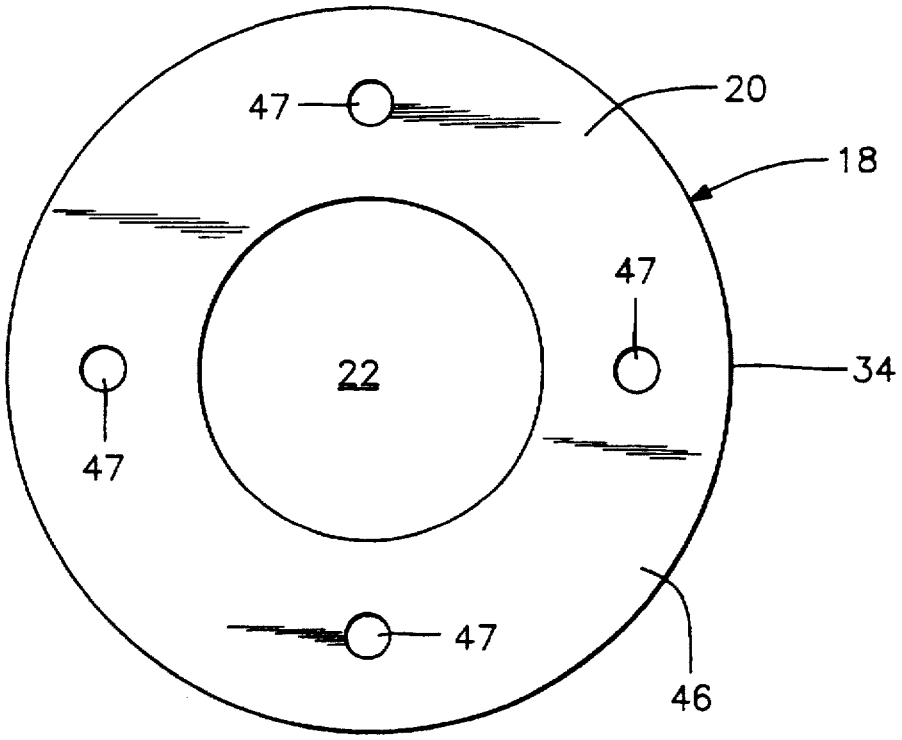
FIG. 4 is a bottom plan view of the tool illustrated in FIG. 2.

It will therefore be seen from FIGS. 1 and 2 that the inlets 47 at the lower ends of the bores 32, and the lower ends of the counterbores 36 and slots 52, define passageways communicating the annular zone 56 interiorly of the casing 10 and exteriorly of the tubing string 16 below the packer 14 with the interior of the tool 18 and its central longitudinal opening or passageway 22 and thence to the interior of the tubing string 16. Accordingly, if a gas pressure buildup occurs within the casing 10 below the packer 14 tending to restrict the flow of oil from the surrounding formation (not shown) into the bottom of the casing 10, as soon as that excess pressure reaches a level approximately 2 psi above the fluid pressure within the tubing string 16, the ball check valves 40 and wipers 41 are designed to move slightly upwardly within the counterbores 36. When the pressure differential of the gas on the exterior of the tubing string 16 to the fluid pressure within the tubing string reaches about 7 psi, the tool is designed so that the ball check valves 40 and wipers 41 have moved to the positions illustrated by the phantom lines in FIG. 2. However, different differential pressures may be utilized depending on the design details of the tool and the pressures encountered in the well. Hence, it is not intended that the present invention be limited to these preferred pressure differentials.

Once the gas starts to flow through the tool 18, the gas within the annular zone then moves upwardly in the general direction of the arrows 57, through the seats 38 and the slots 52 into the central longitudinal opening 22. From there, the gas flows upwardly through the central longitudinal opening 22 with the oil being pumped upwardly through the tubing string 16 from the bottom of the well, generally indicated by arrow 58. The gas is thus diverted by the tool of the present invention until the excess pressure in the casing has been relieved. Of course, once the excess gas pressure is relieved, the ball check valves 40 and wipers 41 return to the solid line positions illustrated in FIG. 2.

The longitudinally straight through bores 32 in the body 20, together with the counterbores 36 and the threaded second counterbores 42 may be formed through relatively easy and inexpensive machining procedures. Also, the undercut zones or portions 48 and 50 also may be inexpensively formed. Further, the tool 18 includes only the body 20, four ball valves 40 and four cylindrical rods 41 for the valve assemblies, and four plugs 44 to close the tops of counterbores 36. Hence, the entire tool 18 is very inexpensive to produce. In addition, the wipers 41 are provided to maintain the ball check valves 40 clean and the lower portions of the counterbores and the slots 52 free of accumulation of various materials which might otherwise tend to clog the gas pressure bypass passages. Still further, the central longitudinal opening 22 is preferably of a larger diameter than, and aligned with, the inside diameters of the tubing string sections, and therefore does not present an obstruction to the passage therethrough of any well bottom repair or maintenance tools. Thus, a pump rod may easily pass and work through the central longitudinal opening 22.

The foregoing is considered as illustrative only of the principles of the invention. Further, since numerous modifications and changes will readily occur to those skilled in the art, it is not desired to limit the invention to the exact construction and operation shown and described. For example, while four gas inlets and check valve assemblies are shown, more or less could be utilized. Further, the positioning of the inlets, the check valve assemblies and the passageways could be altered so long as the central longitudinal opening or passageway remains unobstructed and the check valve assemblies operate to transmit gas flow from the annular zone between outside the tubing and inside casing below the packer to the interior of the tool and then up inside the tubing. Accordingly, all suitable modifications and equivalents may be resorted to, falling within the scope of the invention.

What is claimed as new is as follows:

1. In combination, an upstanding well tubing string having a tubular packer connected therein, an elongated tubular gas diverter tool threadedly connected in said well tubing string below said packer, said tool having a generally tubular body with a substantially central opening, said well tubing string, packer and tubular body defining a substantially coaxial longitudinal central passageway therethrough, said tubular body including at least one gas pressure relief passageway formed therein including an inlet end portion opening exteriorly of said tubular body and an outlet end opening into said central unobstructed longitudinal opening, and a check valve operatively associated with said gas pressure relief passageway closing said relief passageway against fluid flow therethrough and opening said gas pressure relief passageway to permit fluid flow therethrough responsive to a predetermined differential fluid pressure exteriorly of said tubular body over the fluid pressure within said tubular body central opening.

2. The combination of claim 1 wherein said body includes a plurality of said gas pressure relief passageways formed therein spaced about said body central opening and extending longitudinally of said body, said inlet end portions opening downwardly from said body along the exterior of said tubing string.

3. The combination of claim 2 wherein said outlet end portions open generally laterally into said body central opening.

4. The combination of claim 1 wherein said body is thick walled and includes a plurality of said gas pressure relief passageways, each of said gas pressure relief passageways including a through bore formed therethrough, said through bores being circumferentially spaced about said body central opening, said through bores including upper end portion counterbores whose lower ends define upwardly facing annular seats, a ball check valve loosely received in each counterbore and seated on said seats and a plurality of elongated wipers loosely received and reciprocal in said counterbores above and downwardly seated against said ball valves, said body central opening including an interior circumferentially extending undercut portion opening into said counterbores generally intermediate upper and lower ends of said wipers, said counterbores having closed upper ends.

5. The combination of claim 4 wherein the upper end portions of said counterbores include threaded second counterbores opening upwardly through the upper end of said body, and closure plugs removable threaded in said second counterbores.

6. In combination, an upstanding well tubing string having a tubular packer connected therein, a gas diverter tool having an elongated tubular body connected lengthwise in said well tubing below said packer, said body defining a central longitudinal passage therethrough at least generally concentric with said tubing string, said body including at least two peripherally spaced, longitudinally extending passageways formed therethrough and spaced about said central passage, said central passage including a diametrically enlarged undercut portion intermediate its opposite ends opening laterally into said passageways, said passageways including reduced diameter lower end portions spaced below said undercut portion and defining upwardly facing annular seats, and a plurality of ball valves loosely received in said passageways and gravity seated on said seats, the upper ends of said passageways being removably closed.

7. The combination of claim 6 wherein said passageways equal four in number.

8. The combination of claim 6 wherein said passageways include threaded upper ends, and closure plugs removable threaded in said upper ends.

9. The combination of claim 6 including elongated rods loosely lengthwise received in said passageways including lower ends downwardly abutted against said ball valves and upper ends spaced above said undercut portion opening into said passageways.

10. The combination of claim 9 wherein said passageways include threaded upper ends, and closure plugs removably threaded in said upper ends.

11. The combination of claim 10 wherein said passageways equal four in number.

12. In an oil and gas production well including an outer casing, a central tubing string in said casing and a leaking zone in said casing spaced above a lower production end portion of said well casing, the method of preventing water and/or mud from entering said casing through said leaking zone and falling downwardly in said casing exteriorly of said tubing string to said lower production end portion of said well and also preventing excess gas pressure buildup in said lower end portion of said well casing, said method including installing a packer on said tubing string at least slightly below said leaking zone to seal the exterior of said tubing string at said packer relative to the opposing inner surfaces of said casing and also serially installing a tubular gas bypass tool in said tubing string below said packer with said bypass tool defining at least one check valved gas bypass passageway therein including an inlet end opening exteriorly of said tubing string into the interior of said casing and an outlet end opening interiorly of said body and operative to flow gas therethrough from the exterior of said tubing string below said packer into the interior of said tubing string responsive to a predetermined pressure differential of gas pressure in said inlet end over the gas pressure in said outlet end.

13. The method of claim 12 wherein the check valve of said passageway is gravity biased to a closed position.

14. The method of claim 13 wherein said check valve comprises a spherical ball check valve disposed within a substantially vertical portion of said passageway intermediate said inlet and outlet ends, and a weighted rod-shaped wiper member loosely received in said vertical proportion and gravity biased downwardly on said spherical ball check valve.

15. A gas diverter tool for serial connection in a tubing string below a packer in a well having a cracked or leaking casing wherein said packer seals off said casing below said crack or leak, said tool comprising an elongated tubular body having a substantially unobstructed longitudinal central opening therethrough which is substantially aligned with said tubing string and said packer, said tubular body including at least one gas pressure relief passageway formed therein with an inlet end opening exteriorly of said tool and an outlet end opening into said central opening, and a check valve operatively associated with said gas pressure relief passageway to close said passageway against fluid flow therethrough and to open said passageway to permit fluid flow therethrough.

16. The gas diverter tool as defined in claim 15 wherein said tubular body includes a plurality of said gas pressure relief passageways equally spaced about said body central opening.

17. The gas diverter tool as defined in claim 16 wherein said gas pressure relief passageways extend substantially longitudinally of said body, said inlet ends opening downwardly from said body along the exterior of said tubing string and said outlet ends opening generally laterally into said body central opening.

18. The gas diverter tool as defined in claim 15 wherein said body is thick walled and includes a plurality of through bores formed therethrough and circumferentially spaced about said body central opening, said through bores including upper end portion counterbores whose lower ends define upwardly facing annular seats, a plurality of ball check valves loosely received in said counterbores and seated on said seats and a plurality of elongated wipers loosely received and reciprocal in said counterbores above and downwardly seated against said ball valves, said body central opening including an interior circumferentially extending undercut portion opening into said counterbores generally intermediate upper and lower ends of said wipers, said counterbores having closed upper ends, said undercut portion, counterbores, and through bores defining said gas pressure relief passageway.

19. The gas diverter tool as defined in claim 18 wherein the upper ends of said counterbores include threaded second counterbores opening upwardly through the upper end of said body, and closure plugs removable threaded in said second counterbores.

20. An oil well tool adapted to be made up into a production tubing string positioned in a well casing with an annulus between the tubing string and well casing and said tubing string having an uninterrupted internal passageway extending therethrough, said tool comprising a tubular body having a longitudinal passageway extending completely therethrough which forms an uninterrupted continuation of said tubing string internal passageway, said body including at least one fluid passage communicating said longitudinal passageway with said annulus between the tubing string and casing, said fluid passage in the body including a gravity operated valve moved between open and closed positions in response to a selected pressure differential between the annulus and the longitudinal passageway.

21. The oil well tool as defined in claim 20 wherein said valve includes an upwardly opening valve seat, a ball valve movably seated on said valve seat and an upwardly extending valve hold down and wiper rod in said fluid passage above and in engagement with said ball valve to act as weight on said ball valve and prevent clogging of the valve and fluid passage.

22. The oil well tool as defined in claim 20 wherein said fluid passage includes a plurality of peripherally spaced, longitudinally extending passages formed in said body generally parallel to said longitudinal passageway and opening out at the bottom of said tubular body into said annulus, said longitudinal passageway through said body including a diametrically enlarged undercut portion generally opening laterally into said passages for communicating the passageway through the body with the annulus.

23. The oil well tool as defined in claim 22 wherein each of said passages includes an upwardly facing annular seat, and a ball valve loosely received in each of said passages and gravity seated on said seats.

24. The oil well tool as defined in claim 23 wherein each of said passages extends longitudinally from a lower end of said body upwardly beyond said undercut portion and including a closed upper end.

25. The oil well tool as defined in claim 23 wherein said passages extend longitudinally completely through said body, each passage including a threaded upper end, and a closure plug removably threaded in each threaded upper end.

26. The oil well tool as defined in claim 23 wherein each passage includes an elongated rod loosely received lengthwise in said passage, each rod including a lower end downwardly abutted against said ball valve and an upper end spaced above said undercut portion in the passageway through the body.

27. An oil well tool comprising a generally tubular body with a central generally cylindrical passageway extending completely therethrough, said tubular body including a plurality of peripherally spaced passages extending generally parallel to said central passageway, said passages including an inlet end opening exteriorly of said tubular body and an outlet end opening into said passageway extending through said body, and a valve operatively associated with said passages to close said passages against fluid flow therethrough and opening said passages to permit fluid flow therethrough responsive to a predetermined differential fluid pressure exteriorly of said tubular body over the fluid pressure in the passageway through said tubular body, said passageway through the body including a diametrically enlarged undercut portion intermediate its opposite ends opening laterally into said passages, said passages including a valve seat spaced below said undercut portion and defining an upwardly facing annular valve seat, said valve being loosely received in said passage and gravity seated on said seat.

28. The oil well tool as defined in claim 27 wherein each valve is a ball valve and an elongated rod loosely received lengthwise in said passages and including a lower end downwardly abutted against said ball valve to provide weight on said ball valve and an upper end movable in relation to said undercut portion to prevent clogging of said passage.

* * * * *